US006052052A

United States Patent [19]

Delmonaco

[11] Patent Number: 6,052,052

[45] **Date of Patent: *Apr. 18, 2000**

[54] PORTABLE ALARM SYSTEM

[75] Inventor: Terry J. Delmonaco, Cypress Creek, Fla.

[73] Assignee: Navarro Group Limited, Inc., Ft. Lauderdale, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 08/920,959

[22] Filed: Aug. 29, 1997

[51] Int. Cl.[7] ..... G08B 1/08

[52] U.S. Cl. ..... 340/539; 340/506; 340/287; 340/307

[58] Field of Search ..... 340/506, 825.06, 340/825.15, 287, 306, 307, 308; 379/39, 41, 42, 44

[56] References Cited

U.S. PATENT DOCUMENTS 5,546,072 8/1996 Creuseremee et al. ..... 340/574
5,587,701 12/1996 Hess ..... 340/539

*Primary Examiner*—Daryl Pope
*Attorney, Agent, or Firm*—Malin, Haley & DiMaggio, P.A.

[57] ABSTRACT

An alarm security system is provided that interfaces a standard communications system with the monitoring of variety of remote sensors resulting in a flexible portable silent alarm. The sensor alarm conditions are communicated, with prerecorded voice information, directly over preprogrammed standard radio communications channels to on-duty security personnel. The equipment responds to commands sent, along with a correct identification code, over the same standard communications channels. Remote arming, disarming, status, activation of listening devices, and other remote functions are therefore possible. The alarm security system includes a remote wireless security electronics unit that is powered by battery, solar panel, or AC. The remote electronics unit includes monitoring of sensors in a plurality of separate zones. Each zone having a separate prerecorded message, appropriate for that zone, that can be transmitted directly to on-duty security personnel. On-duty personnel can remotely operate the unit over the radio, and can activate a remote microphone to establish an audio link with the scene of the triggering event. In one embodiment, the unit can be placed in a remote area or city street as an emergency call box. Upon activation of a panic button, or opening a door, the unit will transmit a prerecorded emergency call directly to on-duty personnel identifying the location, nature of the emergency, and other information. The unit can communicate instructions to the user and can place the user in direct two-way communication with on-duty personnel.

30 Claims, 4 Drawing Sheets

PORTABLE ALARM SYSTEM

BACKGROUND OF THE INVENTION

1. Field of the Invention

The present invention relates to emergency signaling and alarm systems and more particularly to portable emergency signaling and alarm systems that, when tripped, can automatically transmit a prerecorded message via radio transmission on a preselected frequency directly to on-duty emergency personnel, and in one embodiment, can locally signal an alarm condition by audio and/or visual indication.

2. Description of Related Art

Alarm systems typically are hardwired in-place and do not have the capability of portability or quick installation. In addition, most alarm systems respond to a triggering event by either locally signaling, such as by siren and/or emergency lights, or by alerting remote monitoring personnel, who must in-turn dispatch on-duty emergency response personnel, such as police or security guards, to the event location.

Dispatching on-duty emergency personnel, even if by direct 911 call, adds a delay to the response time required for the responding personnel to reach the event site. Often, a delay in response time can mean the difference between arriving to a location "after-the-fact" or in-time to prevent or apprehend the perpetrator of an incident such as burglary.

For example, a number of shops may be experiencing a series of smash and grab burglaries, a crime that can be committed within two minutes. By the time police are dispatched to an alarm system, the perpetrators are long gone. With the existing 911 and dispatch service delays, protecting an entire block of buildings can require a number of officers to stake-out, or provide visual contact, with each of the target shops.

Today's police and security forces need crime prevention tools that increase the productivity of the individual officer and are flexible enough to handle a variety of scenarios. If security and police forces can apply their limited resources in a timely manner to crimes as they are being developed by the criminal elements, the effectiveness of law enforcement services will increase.

There is a need for equipment that permits a single officer to receive an immediate indication of the occurrence of a criminal offense including the location and other assessing information. The equipment should provide a rapid response capability directly to the responding officer, bypassing the inherent delays of 911 telephone and police dispatch personnel. In addition, the equipment should be portable and simple to set up in a short period of time, preferably without requiring the officer to carry any new or additional equipment.

The present invention accomplishes the above, as described herein below.

SUMMARY OF THE INVENTION

An alarm security system is provided that interfaces a standard communications system with the monitoring of a variety of remote sensors resulting in a flexible portable emergency alarm system. The equipment provides establishment of a wireless remote monitored security system with a variety of sensors in a short period of time. The system can provide silent alarm indications monitored remotely, and/or local emergency audio and/or visual alarm signaling.

The alarm security system includes a remote security electronic controller that can be battery, solar, or AC powered. The electronic controller monitors a plurality of sensors that are separated into a plurality of separate zones. Each sensor preferably provides standard normally open and/or normally closed trip indications. The controller can be quickly placed at the site to be monitored, and the sensors positioned in suitable zone locations.

The electronic controller includes static solid state memory that can store at least one prerecorded audible message (saved when power is disconnected). Messages appropriate for each zone can be field recordable for playback, as described herein below.

The controller is interfaced to a radio transceiver which is setable to a preselected radio frequency channel. The radio transceiver can provide a link to the standard radio communications system of on-duty security personnel. When the controller receives a tripped sensor indication, the prerecorded message for the particular zone having the tripped sensor is transmitted by the radio transceiver over the preselected frequency channel. Security personnel can receive the prerecorded message indicating an emergency condition directly on their standard radios, not relayed to them by a dispatcher.

The controller includes receiver decode logic to receive and decode commands sent to the transceiver, over the same standard communications channels, by security personnel. Commands sent, along with a correct identification code, can remotely control various functions of the controller.

Examples of controllable functions include remote arming, disarming, status, activation of sensors and listening devices, and other remote functions. Thus, the controller can be armed and disarmed (activated and deactivated) remotely over the radio channel. The status function can report the armed or disarmed status condition of the controller and can transmit the prerecorded zone messages over the radio channel.

A listening device can be activated at the controller's site to provide an audio radio transmission of a preselected duration from the remote site. The controller includes at least one microphone interface to provide the listening function from a microphone located in the desired area for listening. Video can also be provided.

The controller can further include a housing with a lockable cover to protect the controller from unauthorized tampering, and an external key to manually arm and disarm the system can be provided.

The controller is preferably flexible and programmable, and can be configured in a plurality of embodiments. As described above, the system can be configured as a portable remote silent alarm system that monitors a plurality of normally open and/or normally closed sensors in a preselected number of zones. The system, including the controller and sensors, can be quickly deployed in a remote site. Upon sensing a tripped sensor, the controller transmits the appropriate zone's prerecorded message over a pre-programmed radio frequency channel directly to on-duty personnel. The direct radio call to on-duty personnel can eliminate dispatcher delays. The on-duty personnel can control the functions of the remote system and actually listen to audio broadcasts from the remote location using a prepositioned microphone.

In an alternate embodiment, the system can be configured as an emergency call box to alert on-duty personnel of an emergency situation in a specific location. For example, the controller could be mounted on a pole or other structure in a remote parking lot to provide additional security. Multiple systems can be placed along city streets to be used as emergency call boxes for police, fire, or other emergency personnel. The controller can be powered with batteries and/or a solar panel to provide uninterrupted operation no matter how remote the location.

The controller can include a remote housing unit that can be provided with at least one "panic" button or a door that, when opened, automatically transmits a prerecorded emergency verbal message, on an appropriate pre-programmed radio frequency channel, to on-duty security personnel. A prerecorded message could then be played on a speaker within the housing unit to advise the user of operation of the system to place the user in direct 2-way communication with security personnel via radio link. The radio link can be established with the radio transceiver and a local microphone interfaced with the controller. The unit could also be equipped with a siren and/or emergency lights that would also be activated in the vicinity of the controller.

Accordingly, it is an objective of the present invention to provide a portable remote silent alarm system that communicates prerecorded voice messages directly to on-duty security and/or police personnel via pre-programmed radio frequency channels.

It is another objective of the present invention to provide a portable remote silent alarm system that includes monitoring trip sensor devices in a plurality of zones.

It is a further objective of the present invention to provide a portable remote silent alarm system that is remotely controllable via radio frequency channel.

It is yet another objective of the present invention to provide a portable remote silent alarm system that can receive audio and/or video from the remote site directly on pre-programmed radio frequency channels.

It is yet a further objective of the present invention to provide a remote alarm system that can automatically communicate the location of the emergency to on-duty security personnel.

It is still another objective of the present invention to provide a remote alarm system that can activate a siren and/or emergency lights.

It is still a further objective of the present invention to provide a remote alarm system that can place the user in direct radio communication with the security personnel.

In accordance with these and other objects which will become apparent hereinafter, the instant invention will now be described with particular reference to the accompanying drawings.

DESCRIPTION OF THE PREFERRED EMBODIMENTS

Figure 1:
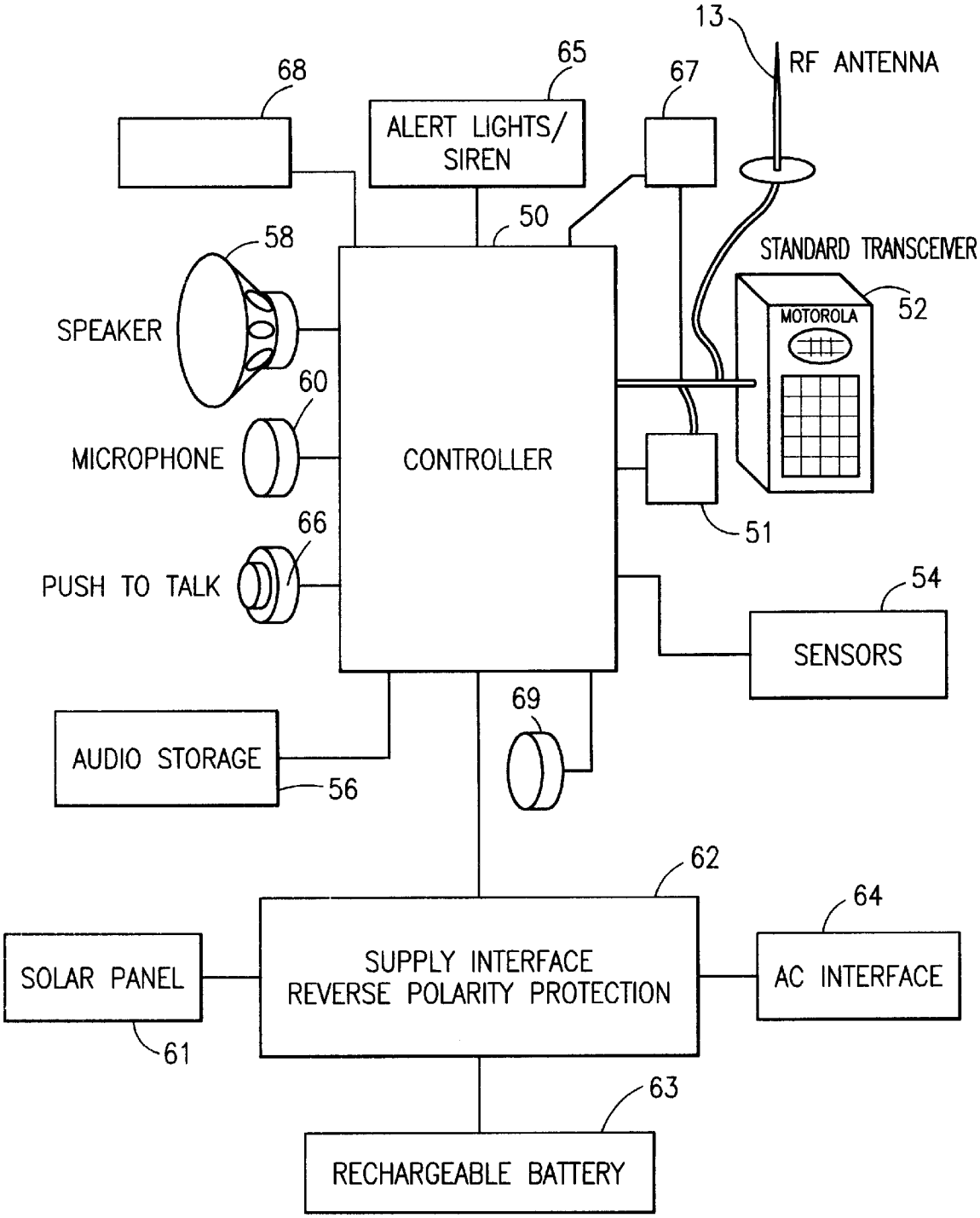
FIG. 1 is a functional block diagram of the present invention.

Referring to FIG. 1, the first embodiment of the present invention includes controller 50, which can be a microprocessor based controller, that is interfaced with a conventional radio transceiver 52. Controller 50 includes command decoding receiver logic 51 for commands received via the communication link with transceiver 52 and antenna 13. Controller 50 includes sensor interface 54, audio storage 56, and can include speaker 58, one or more microphones 60, one or more remote microphones 69, and one or more video sensors 67, as fully described herein below. A display 68, such as a 4 line character liquid crystal display (LCD), can be connected to controller 50 for displaying service and user information.

Controller 50 can be powered through a flexible supply interface 62 which can supply power from any number of sources such as solar panels 61, rechargeable or non-rechargeable DC batteries 63, or AC power 64.

Sensor interface 54 can interface with any sensor configurable as a normally open (NO) or normally closed (NC) contact type sensor. Controller 50 and sensor interface 54 permit the sensors to be placed in a plurality of different zones, each zone being a discrete area to be protected.

Controller 50 can also monitor the supply voltage condition, especially important for battery powered units, illuminate status lights, provide for manual arming or disarming of the system, and include external microphone inputs.

In the first embodiment, controller 50, can be portable and readily set-up for monitoring a desired location with appropriate sensors placed in the various zones of interest. Audio messages can be field recorded and stored via microphone 60 and audio storage 56. Preferably, audio storage 56 will be a static solid state memory storing the message in digital electronic form, but can be any audio storage medium. Messages appropriate for each zone being monitored will be recorded and stored.

When controller 50 senses a tripped sensor 54, the prerecorded message, appropriate for the zone tripped, will be transmitted by transceiver 52 and antenna 13 over standard preselected radio frequency channel directly to on-duty security personnel. The message can include the location of the tripped zone or the event and other appropriate information. The on-duty personnel can respond quickly and immediately without dispatcher delays.

The on-duty personnel can also radio to the transceiver 52 and send command codes to controller 50. The received radio transmission will be decoded by decoding logic 51. The received transmission must include correct addressing information for controller 50 to accept commands. The commands sent can include arming (activation), disarming (deactivation), status, and permit activation of a remote microphone 69 and/or camera 67 to provide remote listening and/or viewing capability over the radio channel to on-duty personnel. The status request can supply the armed, unarmed, and battery status, and can playback the prerecorded zone messages over the radio channel.

Controller 50 is flexible and can be readily utilized in alternate embodiments. For example, controller 50 can be configured as a stationary emergency call box that can be placed in a remote location, or along city streets for added security.

In this second embodiment, controller 50 can include audio and/or visual alarm 65, and radio call switch 66. Controller 50 can be configured such that activation of relay closures set off alert lights and/or a siren 65, and can be activated by depressing one or more "panic buttons" or opening an external door (not shown). A prerecorded audio message will automatically be transmitted over preselected radio frequency channels, by transceiver 52, to on-duty security personnel indicating the exact location of the call box and other pertinent information.

A prerecorded message can also be set to playback at the location of the remote system via speaker 58, to give the user instructions on operation of the system. Visual instructions can be displayed on display 68. The instructions can include how to place the user in direct voice communication with on-duty personnel such as by depressing microphone activation switch 66 and talking into microphone 60.

Figures 2A, 2B:
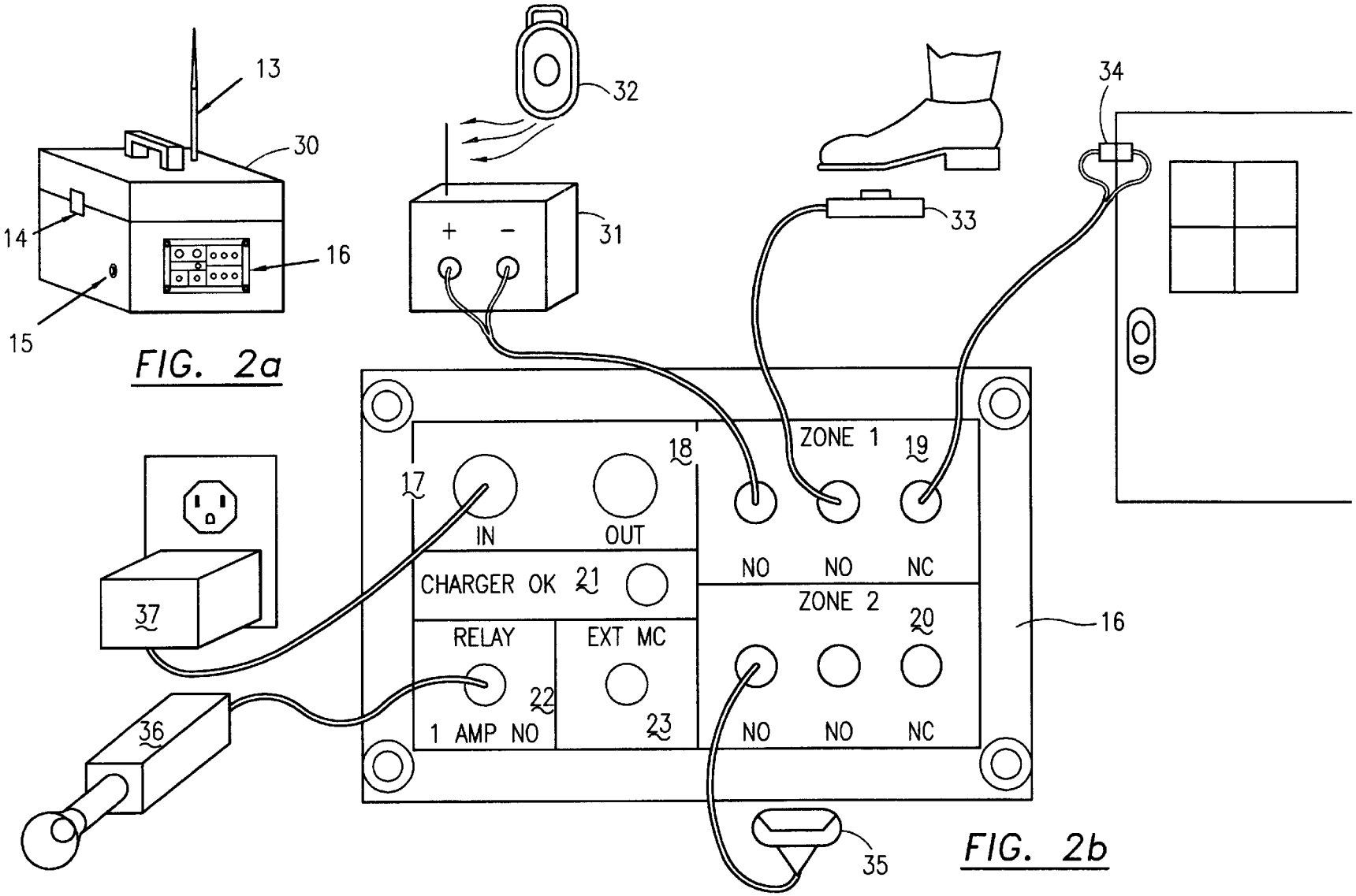
FIG. 2*a* is a perspective view of one embodiment of the present invention.
FIG. 2*b* is a schematic interconnection diagram of the embodiment of FIG. 2*a*.

Further details of the present invention configured in the first embodiment as a portable silent alarm, are discussed herein below using a specific implementation as an example. Referring to FIG. 2*a*, the system, shown functionally in FIG. 1, can be housed in a self-contained portable box 30. Housing 30 includes external antenna 13, interface panel 16, latch and lock 14, and arm/disarm key activated switch 15. External antenna 13 can be removably connected to a conventional connector such as a BNC type connector (not shown).

Referring to FIG. 2*b*, the example includes two zones 19 and 20, each zone having two NO and one NC sensor inputs. Tripping any one of the NO or NC inputs will result in a prerecorded zone one transmitted message cycle if the unit is armed.

The supply voltage 17 is selected to be external DC input, and DC output 18 is provided to supply power to an active sensor 31, which in the example is a wireless "panic button" sensor 32. A charger OK indicator light 21 is illuminated when the external AC transformer 37 is connected and working properly to supply DC supply voltage.

Active sensor 31 can be connected to one of the two NO inputs in zone one. The other NO input can be connected to a wired panic button 33. The NC input can be connected to door sensor 34. External microphone interface 23 can be connected to a remote microphone 35 to monitor the audio at the crime scene. When activated, audio of the crime scene is transmitted over the preselected radio frequency channel for a preselected duration of time. Preferably, the preselected duration of time for audio transmission will be selected to be one minute.

Relay output 22, which can have one ampere rated normally open relay contacts, can be connected to siren 36 or video camera 67, and is selected to be activated only by a zone one trip.

Figure 3:
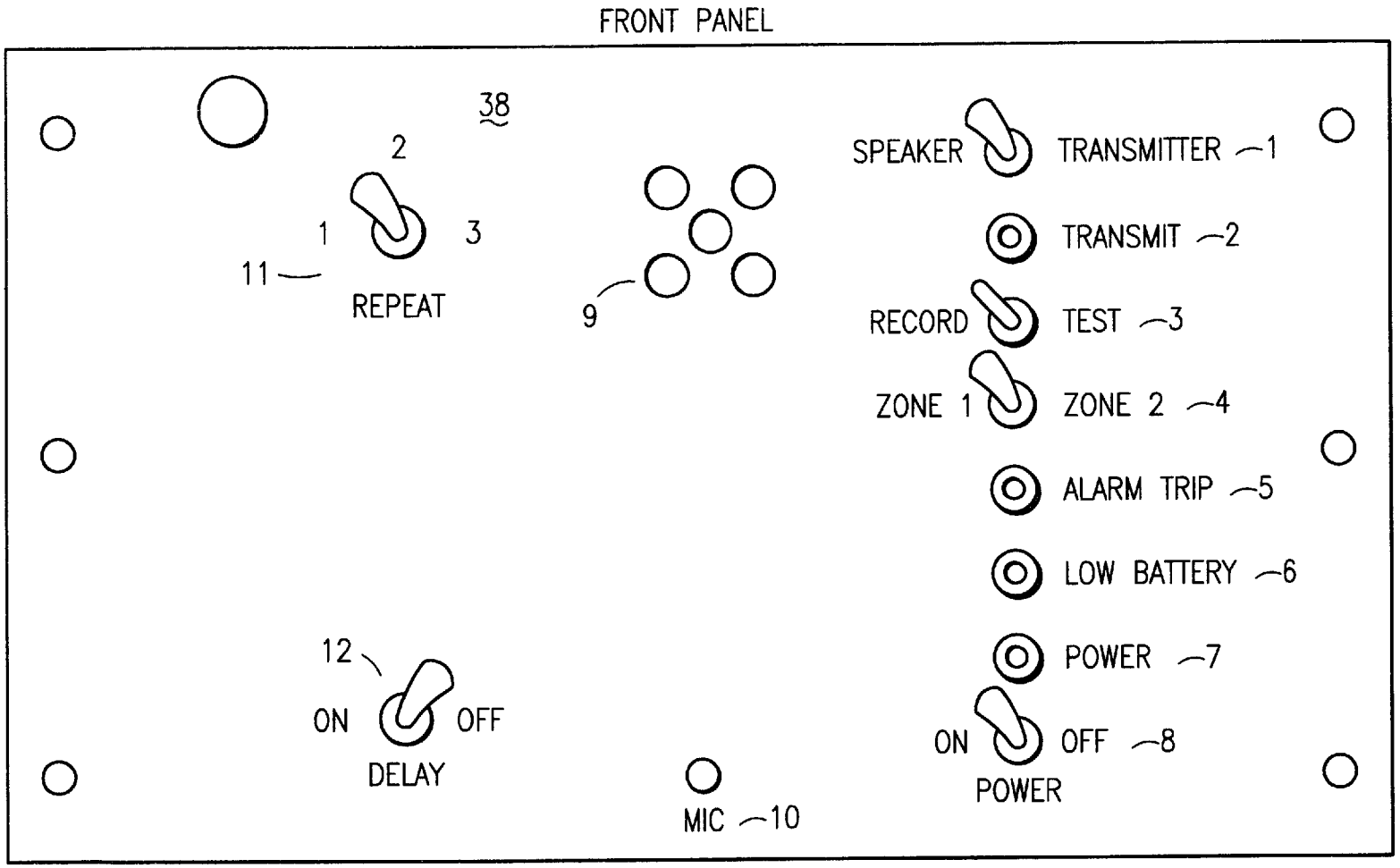
FIG. 3 is a front elevational view of the front panel of one embodiment of the present invention.

Referring to FIG. 3, inside housing 30 can be a manual control panel 38. Manual control panel 38 can include the following.

Speaker/transmitter switch 1 which connects the system audio playback to the internal speaker 58 or the radio transceiver 52.

Transmit Indicator 2 can be illuminated when the radio transmitter 52 is activated by controller 50.

Radio/test switch 3 can be a three position momentary switch for recording zone 1 and 2 messages and playing the message back on the internal speaker 58, or over radio 52.

Zone 1/zone 2 switch 4 can provide access to the prerecorded zone 1 or zone 2 message for record/test switch 3 activity as described above.

Alarm trip indicator 5 can be illuminated when a normally open (NO) or closed (NC) zone 1 or zone 2 device has been tripped. The indicator goes out when the trip has been serviced if the unit is armed and the trip has been cleared.

Low battery indicator 6 can be is illuminated when the supply voltage drops below a preselected level. For example, when a 12.0 volt internal battery drops below 10.5 volts, indicator 6 will be illuminated, and a low battery indication will be transmitted over the radio channel.

Power indicator 7 can be illuminated when the unit is on and active. The power 7 and alarm trip 5 indicators can blink three times at initial power-on to indicate that an internal system check is underway.

On/off switch 8 can disconnect all circuits from the supply voltage, including the external 12 VDC power output jack 18 on the side panel 16.

Speaker orifice 9 can provide audio access to speaker 58, mounted internal to housing 30 in this embodiment, for testing recorded zone messages without using the radio transmission system.

Microphone orifice 10 can provide access to microphone 60, mounted internal to housing 30 in this embodiment, for field recording of the zone 1 and 2 tripped messages. The unit can automatically limit the zone messages to a preselected length, such as 8 seconds.

Repeat switch 11 is a three position switch for selection of the number of times the tripped messages can be repeated during a tripped cycle. There is a short pause between repeated messages of less than one second. The messages are processed once for each trip before clearing the cycle.

On/off delay switch 12 selects the exit and entry delay. The exit and entry delays are preselectable. A standard exit delay is 30 seconds with a one minute entry delay. The entry and exit delays provide a time delay before alarm activation to enable a user to either exit the secured area after arming the system, or to disarm the system after entering the area and tripping a sensor.

A suitable set-up procedure for the above example can be implemented as follows:

1. With the power switch (8) in the off position, connect the side external trip devices as desired to zone 1 (19) and 2 (20), external microphone (23), relay (22), 120 VAC wall transformer to 12 VDC battery charger input (17), and external 12 VDC output supply (18). If the battery charger is connected and working the charger OK indicator (21) will be on.
2. Before turning the power switch to the on position, set the delay switch (12) to off, speaker/transmitter (1) to speaker, and the manual arm/disarm switch (15) fully counterclockwise to the disarm position. Turn the power switch on, and observe the power indicator (7) and the alarm trip indicator (5) alternate back and forth three times. When the power indicator (7) is on continuously the internal system testing is complete.
3. Select the desired zone 1 or 2 switch (4) position for recording the trip message to be transmitted.
4. Recording is done by pushing the momentary three position record/test switch (3) to record and holding while speaking the message into the microphone (10). When the message is complete release the record test switch. The message is limited to a preselected maximum length, and is initially set to 8 seconds.
5. To test the recorded message push the record/test switch the test position and hold. The message will repeat until the record/test switch is released.
6. Repeat steps 3 through 5 to redo a message or record a message for the other zone.
7. If a zone is not used, the previously stored messages should be removed. This is done by momentarily pushing the record/test switch to record once the zone switch has been selected.
8. At this point the trip devices should be tested one at a time. When the devices are tripped the alarm trip indicator (5)

will come on and the message will begin immediately at the speaker. Wait for the message to complete and the alarm indicator to go off before tripping additional device on the same zone.

9. Now place the speaker/transmitter switch (1) in the transmitter position and push the record/test switch (3) to test. This will provide an over the air test of the unit and system.
10. Select the desired number of message repeats with the repeat switch (11). The message is repeated with no delay the selected number of times selected, once for each trip cycle.
11. If desired, turn the delay switch to the on position. This provides a preselected exit delay when the manual arm/disarm switch (15) is armed. A preselected entry delay can be provided after a trip has occurred before the message is transmitted. The initial duration for exit and entry is 30 seconds and 60 seconds, respectively. A remote arming of the unit over the radio channel is always done with no exit delay regardless of the delay switch position.
12. Close cover and lock the latch (14). This will limit access to the controls and on/off switch. The unit is now ready to be armed with the manual external key switch (15), by turning clockwise.
13. This unit can be armed and disarmed remotely over the air with a radio transmitter. Select the desired unit's address, or identification code, which can be a three digit code followed by the # symbol.
14. This can be followed by the desired preprogrammed function, such as: 01—armed; 02—disarmed; 03—status; and, 04—eaves (for remote audio and/or video). These functions can be preprogrammed to perform the following actions:

01—armed:

Remote arming of the unit overrides the manual arm/disarm switch with no delay. If delay switch 12 is on, entry is active. The manual switch can be used to disarm the unit once remotely armed. An armed transmission will occur if the speaker/transmitter switch is in the speaker position.

02—disarmed:

Remote disarm of the unit overrides the manual arm/disarm switch with no delay. A disarm transmission will occur if the speaker/transmitter switch is in the speaker position.

03—status:

The armed/disarmed and battery status of the unit will be transmitted followed by the zone 1 and 2 messages. There is no change to the system's armed/disarmed condition.

04—eaves:

The radio will transmit for a preselected duration with the audio connected to the side panel microphone jack 23. This can be repeated as soon as the preselected time expires. The initial duration is preset to one minute. Video information can also be transmitted.

Figure 4:
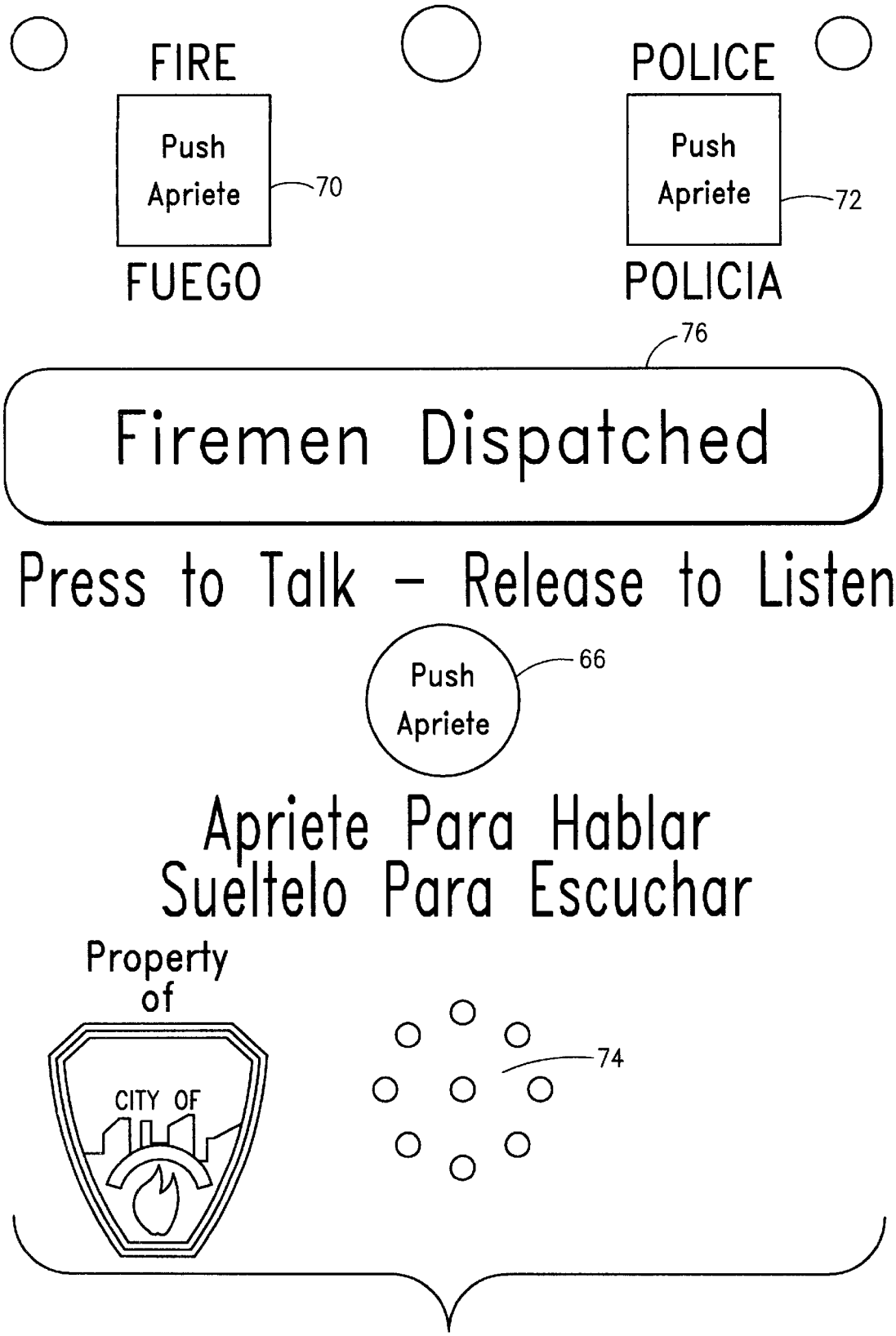
FIG. 4 is a front elevational view of the front panel of an alternate embodiment of the present invention.

Referring to FIG. 4, an example of the system configured in the second embodiment as an emergency call box is discussed herein below using a specific implementation as an example. In the second embodiment, as discussed herein above, panic button 70 can be used to call the fire department and panic button 72 can be used to call the police department. Upon depressing button 70 or 72 an appropriate prerecorded message can be transmitted to the appropriate emergency personnel. The message can be sent directly to on-duty personnel via their radios, or can be sent to a dispatcher. Transmissions to a dispatcher are typical for emergency calls to the fire department because fire department personnel are dispatched from a fire station and are not typically on patrol. The prerecorded message can include the location of the emergency and other pertinent information.

Once button 70 or 72 has been depressed, and the prerecorded message is transmitted to emergency personnel, a second prerecorded message can instruct the user on placing the user in two-way communication with the emergency personnel. Speaker 58 (FIG. 1) can be heard by the user through speaker orifice area 74. Depressing microphone button 66 enables the user to talk directly to the emergency personnel through microphone 60 (FIG. 1). A suitable display 76 can indicate to the user that the appropriate emergency personnel have been called.

For hearing challenged users, display 76 can be configured as a push button "yes"/"no" question and answer communication mode using buttons 70 and 72. For example, a displayed message such as "Is this an emergency?" would be answered "yes" by depressing button 70, and "no" by depressing button 72.

In addition, a vibration sensor can be installed within the call box to sense tampering and to automatically call authorities with a prerecorded message to alert them to the tampering. Maintenance indications, such as a low battery prerecorded message can be sent to maintenance personnel to identify call boxes that require replacement batteries and other maintenance.

Video communication can be provided between the call box and emergency personnel. A video camera set up at the call box can send video images to emergency personnel to monitor the area around the call box.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A portable alarm system for communicating with a standard frequency two-way, hand-held, portable RF radio conventionally used by security personnel comprising:

a portable controller including a programmable solid state memory having memory for storing a pre-recorded audio message delineating a specific zone of security coverage and having means for monitoring at least one physical security sensor;

a plurality of physical security sensors for sensing security violations in one or more zones connected to said controller, said sensors having at least a tripped and a non-tripped state;

a microphone connectable to said controller for audibly transmitting and pre-recording an audio message delineating a particular geographical area of protection such as a zone of security protection that is subject to said physical security sensors connected to said portable controller;

means for transmitting said pre-recorded audio message delineating the specific zone of coverage by said controller over said radio frequency having a predetermined RF frequency to communicate with said standard frequency two-way hand-held portable radio utilized by security personnel in response to an activated physical security sensor connected to said controller, said controller triggering said means for transmitting in response to said means for monitoring when at least one sensor is in the tripped state; and means for reeving and decoding at least one preprogrammed command sent over said pre-selected radio frequency channel, said controller responsive to said at least one preprogrammed command, said pre-selected radio frequency being in a frequency band receivable and transmittable by a conventional emergency personnel radio.

2. The portable alarm of claim 1 wherein said means for storing said at least one audio message includes means for recording said message.

3. The portable alarm of claim 2 further including a portable housing for mounting said controller.

4. The portable alarm of claim 3 further comprising:

a microphone input jack mounted on said housing and electrically connected to said controller;

means for transmitting audio from said microphone input jack over said preselected radio frequency channel.

5. The portable alarm of claim 3 further comprising:

means for receiving video connectable to said controller;

means for transmitting video over said preselected radio frequency channel.

6. The portable alarm of claim 3 wherein said at least one sensor is a plurality of sensors connectable to at least two monitoring zones and at least one of said plurality of sensors being remote from said housing.

7. The portable alarm of claim 6 wherein said plurality of sensors include at least one normally open and at least one normally closed contact trip sensor.

8. The portable alarm of claim 7 wherein there are two monitoring zones, each zone connectable to two normally open contact trip sensors and to one normally closed contact trip sensor.

9. The portable alarm of claim 3 further including means to activate at least one audio alarm local to said housing.

10. The portable alarm of claim 3 further including means to activate at least one visual alarm local to said housing.

11. The portable alarm of claim 3 wherein said housing includes a visual status indicator for said means for supplying power and further includes a power output jack.

12. A portable alarm system for alerting security personnel remotely stationed with a conventional two-way radio using a predetermined frequency comprising:

a portable housing;

an electronic controller mounted in said housing;

means for recording and means for storing at least one audio message delineating the location of said portable housing, said means for recording and said means for storing electrically connected to said controller;

said controller including means for monitoring at least one sensor in a predetermined security zone described in said stored audio message;

means for transmitting said audio message over a first preselected radio frequency channel, said means for transmitting electrically connected to said controller and to said means for storing;

means for receiving and means for decoding at least one command sent over a second preselected radio frequency channel, said means for receiving and said means for decoding electrically connected to said controller;

means for supplying power;

wherein said controller is remotely controllable by said at least one command sent over said second preselected radio frequency channel, and when said at least one physical security sensor is activated and said at least one stored audio message is transmitted over said first preselected radio frequency channel describing the location of the sensor activated, said first and said second preselected radio frequency channels each being in a frequency band receivable and transmittable by a conventional emergency personnel radio.

13. The portable alarm of claim 12 further comprising:

a microphone input jack mounted on said housing and electrically connected to said controller;

means for transmitting audio from said microphone input jack over said preselected radio frequency channel.

14. The portable alarm of claim 12 wherein said at least one sensor is a plurality of sensors connectable to at least two monitoring zones and at least one of said plurality of sensors being remote from said housing.

15. The portable alarm of claim 14 wherein said plurality of sensors include at least one normally open and at least one normally closed contact trip sensor.

16. The portable alarm of claim 15 wherein there are two monitoring zones, each zone connectable to two normally open contact trip sensors and to one normally closed contact trip sensor.

17. The portable alarm of claim 12 further including means to activate at least one audio alarm local to said housing.

18. The portable alarm of claim 12 further including means to activate at least one visual alarm local to said housing.

19. The portable alarm of claim 12 wherein said first and said second preselected radio frequency channels are the same channel.

20. The portable alarm of claim 12 wherein said housing includes a visual status indicator for said means for supplying power and further includes a power output jack.

21. The portable alarm of claim 12 further comprising:

means for receiving video information connectable to said controller;

means for transmitting video information over said preselected radio frequency channel.

22. A remote emergency call box comprising:

a portable housing;

an electronic controller mounted in said housing;

means for recording and means for storing at least two audio messages, said means for recording and said means for storing electrically connected to said controller said audio messages describing the location of the portable housing;

means for monitoring at least one physical security sensor electrically connected to said controller;

means for automatically transmitting a first of said at least two audio messages over a preselected radio frequency channel upon activation of said at least one physical security sensor, said means for automatically transmitting electrically connected to said controller and to said means for storing;

means for automatically playing back a second of said at least two audio messages locally at said housing upon activation of said at least one sensor, said means for automatically playing back electrically connected to said controller and to said means for storing;

means for supplying power;

wherein when said at least one sensor is activated said first of said at least two stored audio messages is transmitted over said preselected radio frequency channel and said second of said at least two stored audio messages is played back locally said housing; said preselected radio frequency being in a frequency band receivable and transmittable by a conventional emergency personnel radio.

23. The remote emergency call box of claim 22 further comprising means to place a user in two-way voice communication over said preselected radio frequency channel to on-duty security personnel.

24. The remote emergency call box of claim 22 further comprising means for activating at least one audio alarm at said housing.

25. The remote emergency call box of claim 22 further comprising means for activating at least one visual alarm at said housing.

26. The remote emergency call box of claim 22 wherein said means for supplying power includes a solar panel.

27. The remote emergency call box of claim 22 wherein there is a third and a fourth recorded and stored audio messages and means for automatically transmitting said third message over a second preselected radio frequency upon activation of a second sensor, and means for playing back said fourth message locally at said housing upon activation of said second sensor.

28. The remote emergency call box of claim 27 wherein said sensors are manual push buttons.

29. The remote emergency call box of claim 22 further comprising;

means for providing two-way communication for hearing challenged users including display means for visual queries for the hearing challenged user and at least one means for response to the visual queries.

30. The remote emergency call box of claim 22 further comprising;

means for activating at least one video sensor and means for transmitting video sensor data over said preselected radio frequency channel.

* * * * *